US005615816A

United States Patent [19]

Deschenes et al.

[11] Patent Number: 5,615,816

[45] Date of Patent: Apr. 1, 1997

[54] DISPENSING OF ATTACHMENTS

[75] Inventors: Charles L. Deschenes, North Attleboro, Mass.; Hitoshi Kogiso, Mizunami, Japan; Tomoyasu Ito, Mizunami, Japan; Hidekatsu Kimbara, Mizunami, Japan

[73] Assignee: Avery Dennison Corporation, Pasadena, Calif.

[21] Appl. No.: 435,039

[22] Filed: May 8, 1995

[51] Int. Cl.[6] ..... B65C 7/00

[52] U.S. Cl. ..... 227/71; 227/76; 227/101

[58] Field of Search ..... 227/67, 68, 70, 227/71, 101, 103, 76

[56] References Cited

U.S. PATENT DOCUMENTS

| | | | |
|---|---|---|---|
| 2,707,783 | 5/1955 | Sullivan | 227/71 |
| 2,716,748 | 9/1955 | Sutton | 227/71 |
| 3,875,648 | 4/1975 | Bone | 227/71 |
| 4,533,076 | 8/1985 | Bourque | 227/71 |
| 5,205,458 | 4/1993 | Kunreuther | 227/71 |
| 5,433,366 | 7/1995 | Deschenes et al. | 227/67 |

*Primary Examiner*—Scott A. Smith
*Attorney, Agent, or Firm*—Kriegsman & Kriegsman

[57] ABSTRACT

Apparatus for dispensing attachments from continuously connected ladder stock of the type comprising a pair of plastic side members coupled together by a plurality of plastic cross links includes a mount, a support movably mounted on the mount, and a pair of carrier blocks mounted on the support. A needle block is mounted on each carrier block and a hollow, slotted needle is mounted on each needle block. A feed mechanism including a pair of feed wheels, is mounted on said support for advancing the ladder stock into the hollow slotted needles and a pair of feed tracks, one for each hollow slotted needle, are provided through which the ladder stock passes from the feed wheels into the pair of hollow slotted needles. A pair of knifes are provided for severing an attachment from the ladder stock, and a pair of ejector rods are provided for ejecting the severed attachment through the hollow slotted needles. The carrier blocks are disposed parallel to each other and movable sideways relative to each other so that the spacing between the hollow slotted needles can be changed for different applications and the feed wheels are disposed parallel to each other and movable sideways relative to each other so that their spacing can be changed to accommodate different widths of ladder stock. In order to provide a path for the ladder stock from the feed wheels to the hollow slotted needles for different feed wheel spacings and/or needle spacings each feed track assembly includes a pivotally mounted section.

8 Claims, 7 Drawing Sheets

DISPENSING OF ATTACHMENTS

BACKGROUND OF THE INVENTION

The present invention relates to the dispensing of attachments and more particularly to an apparatus for dispensing attachments from continuously connected ladder stock.

In commonly assigned U.S. Pat. No. 3,875,648, which is incorporated herein by reference, there is disclosed a fastener attachment apparatus and method for separating a fastener attachment device comprising two end bars and a filament coupled therebetween from stock comprising two undivided and continuous side members and a plurality of cross links coupled therebetween and dispensing the devices through one or more slotted needles by pushing an end bar of the device through a slot in the needle. In addition, there is disclosed a fastener attachment apparatus and method for simultaneously pushing each of the two end bars of a fastener attachment device through two slotted needles with the filament between the end bars extending through the slot of each of the needles and between the needles.

In commonly assigned U.S. Pat. No. 4,039,078, which is also incorporated herein by reference, there are disclosed several different types of attachments which are fabricated as part of continuously connected ladder stock. In each instance, the attachment has an H-shape, and the ladder stock is formed from two elongated and continuous plastic side members coupled together by a plurality of plastic cross links, the cross links preferably being equidistantly spaced. The stock may be produced from flexible plastics material including nylon, polypropylene and other similar materials by molding or by stamping. Either manually or with the aid of specifically designed devices, individual attachments may be dispensed from the ladder stock to couple buttons to fabric, merchandising tags to articles of commerce, or, in general, any two desired articles. In those instances where the dispensing device has dual needles, the attachments severed from the stock can be used like staples to secure objects and items.

In commonly assigned U.S. Pat. No. 4,877,172, which is also incorporated herein by reference, a device for dispensing attachments of the type described above is disclosed. The device disclosed therein includes a reciprocatively mounted shuttle which fixedly carries a pair of hollow slotted needles and which moves between an attachment severing position and an attachment dispensing position. A feed belt, which is driven by a pair of sprockets, is used to incrementally advance the ladder stock so that, at the end of each attachment dispensing cycle, a single attachment is fed into the needles at the attachment severing location. Once the attachment has been fed into the pair of needles, a slidably mounted knife blade severs the attachment from the remainder of the ladder stock, and the shuttle is moved to the attachment dispensing location where the needles are aligned with a pair of plungers. The plungers are then inserted into the needles to expel the attachment therefrom. Thereafter, the plungers retract and the shuttle moves back into the attachment severing location to accept another attachment. The shuttle, feed belt, knife blade and plungers are mounted to a head member. The head member is driven between an attachment dispensing position and a withdrawn position by an electric motor driven assembly.

In commonly assigned U.S. patent application Ser. No. 08/025,044, and corresponding published PCT Application No. PCT/US94/01855, which are both also incorporated herein by reference, there is disclosed a device for dispensing plastic attachments of the type which are formed as part of a roll of continuously connected ladder stock. In one embodiment, the device includes a pair of hollow slotted needles each having a tip, a rear end and a longitudinal axis. A feed wheel, placed proximate to the rear ends of the pair of needles, is used to feed individual attachments of a roll of ladder stock into said pair of needles through their respective rear ends at angles relative to the longitudinal axes thereof. Once inserted into the needles, an attachment is severed from the remainder of the ladder stock by a knife and is then expelled from the needles by a pair of ejector rods movable along the longitudinal axes of the pair of needles. Because attachments are fed into the pair of needles at angles relative to their longitudinal axes, no shuttling of the needles between an attachment feeding position and an attachment ejecting position is required. The pair of needles, the feed wheel, the knife, and the pair of ejector rods are all mounted on a vertically movable head member. An electric motor assembly is used to move the head member between an attachment dispensing position and a withdrawal position. The vertical movement of the head member drives the operation of the feed wheel, the knife and the ejector rods.

Another pertinent patent is commonly assigned U.S. Pat. No. 4,533,076. This patent, which is also incorporated herein by reference, discloses another device for dispensing attachments from continuously connected ladder stock.

SUMMARY OF THE INVENTION

It is an object of the present invention to provide a new and novel apparatus for dispensing attachments from continuously connected ladder stock.

It is an additional object of the present invention to provide a new and novel apparatus for dispensing attachments from continuously connected ladder stock wherein the attachments serve as staples.

It is another object of the present invention to provide an apparatus as described above which includes a feed mechanism which can be adjusted to accommodate different widths of ladder stock.

It is still another object of the present invention to provide an apparatus as described above which includes a pair of parallel disposed needles whose spacing can be adjusted to accommodate different sized items with which the attachments may be used.

It is still yet another object of the present invention to provide an apparatus as described above which includes a pair of feed tracks which can be adjusted to accommodate adjustments which may be made in the feed mechanism and/or needle spacing.

It is a further object of the present invention to provide an apparatus as described above in which the needle spacing can be adjusted independent of the feed mechanism and in which the feed mechanism can be adjusted independent of the needle spacing.

Apparatus for dispensing attachments from continuously connected ladder stock, of the type comprising a pair of plastic side members coupled together by a plurality of plastic cross links according to this invention comprises a frame and a head assembly.

The head assembly comprises a mount and a head, the head including a support movably mounted on the mount, a pair of carrier blocks mounted on the support, a pair of needle blocks, one mounted on each carrier block, a pair of hollow, slotted needles, one mounted on each needle block, a feed mechanism mounted on the support for advancing the continuously connected ladder stock into the hollow slotted needles, the feed mechanism including a pair of feed wheels, a pair of feed tracks, one for each hollow slotted needle, through which the continuously connected ladder stock passes from the pair of feed wheels into the pair of hollow slotted needles, severing means for severing an attachment to be dispensed through said hollow slotted needles from the continuously connected ladder stock, and ejector means for ejecting a severed attachment through the hollow slotted needles, the carrier blocks being disposed parallel to each other and being movable sideways relative to each other so that the spacing between the hollow slotted needles can be changed to accommodate use with items of different sizes, the feed wheels being disposed parallel to each other and being movable sideways relative to each other so that their spacing can be changed to accommodate different sized continuously connected ladder stock, the carrier blocks being movable sideways relative to each other independent of the feed wheels and the feed wheels being movable sideways relative to each other independent of the carrier blocks, each one of said pair of feed tracks being constructed to enable said continuously connected ladder stock to travel through it from the feed wheels into the hollow slotted needles even though the feed wheel spacing is changed and/or the needle spacing is changed.

Various features an advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate a preferred embodiment of the invention and, together with the description, serve to explain the principles of the invention. In these drawings wherein like reference numerals represent like parts.

DETAILED DESCRIPTION OF PREFERRED EMBODIMENTS

The present invention is directed to an apparatus for dispensing attachments from continuously connected ladder stock.

Figure 1:
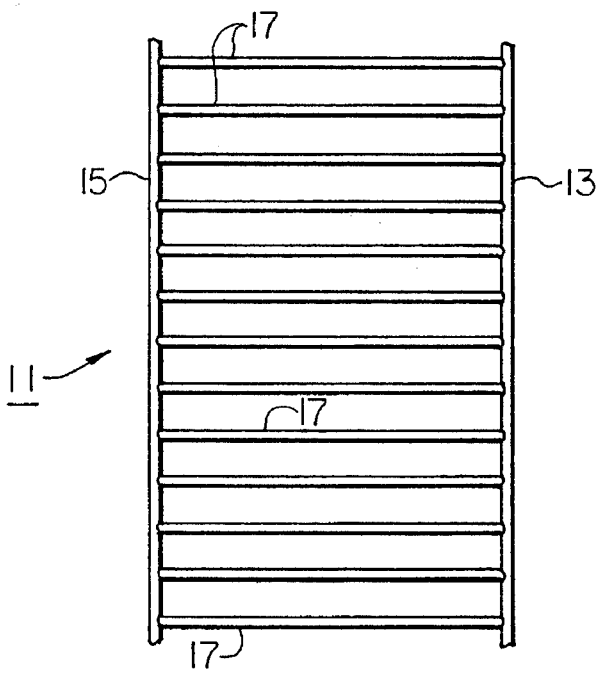
FIG. 1 is a plan view of a length of continuous connected ladder stock which may be used with the apparatus of this invention.
Figure 2:
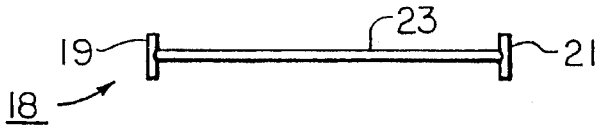
FIG. 2 is a plan view of an attachment obtained from the ladder stock shown in FIG. 1, using the apparatus of this invention.

Referring now to FIG. 1 there is shown a plan view of a length continuously connected ladder stock 11 with which the apparatus of this invention may be used. Ladder stock 11 is preferably made of plastic and comprises a pair of side members 13 and 15 interconnected by a plurality of cross links 17. An attachment 18 which is obtained from ladder stock 11 is shown in FIG. 2 and comprises a pair of end bars 19 and 21 interconnected by a filament 23 with end bars 19 and 21 comprising sections of side members 13 and 15, respectively, and filament 23 comprising a cross link 17.

The apparatus of this invention may be used, for example, to dispense attachments for securing objects to backing plates, such attachments being commonly referred to when used for that application as plastic staples.

Figure 3:
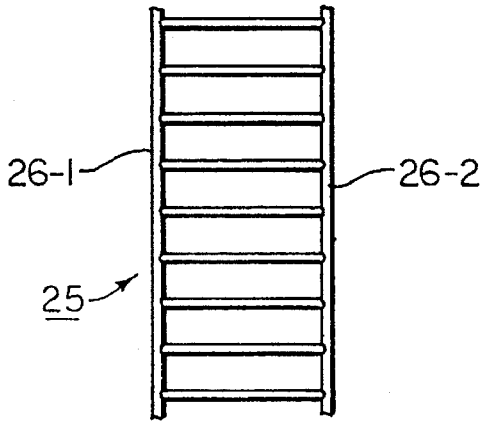
FIG. 3 is a plan view of a length of continuous connected ladder stock whose size is smaller than the continuously connected ladder stock shown in FIG. 1.

Referring now to FIG. 3, there is shown an example of another length of continuously connected ladder stock, the stock in FIG. 3 being identified by reference numeral 25. Ladder stock 25 differs from ladder stock 11 in that its width i.e. the distance between the side members 26-1 and 26-2, is less than the width of ladder stock 11.

As will hereinafter be explained in detail, the apparatus of this invention may be adjusted to accommodate changes in the size of ladder stock to be used and also to adjust the needle spacing to accommodate changes in the size of the objects with which the attachments are to be used.

Figure 4:
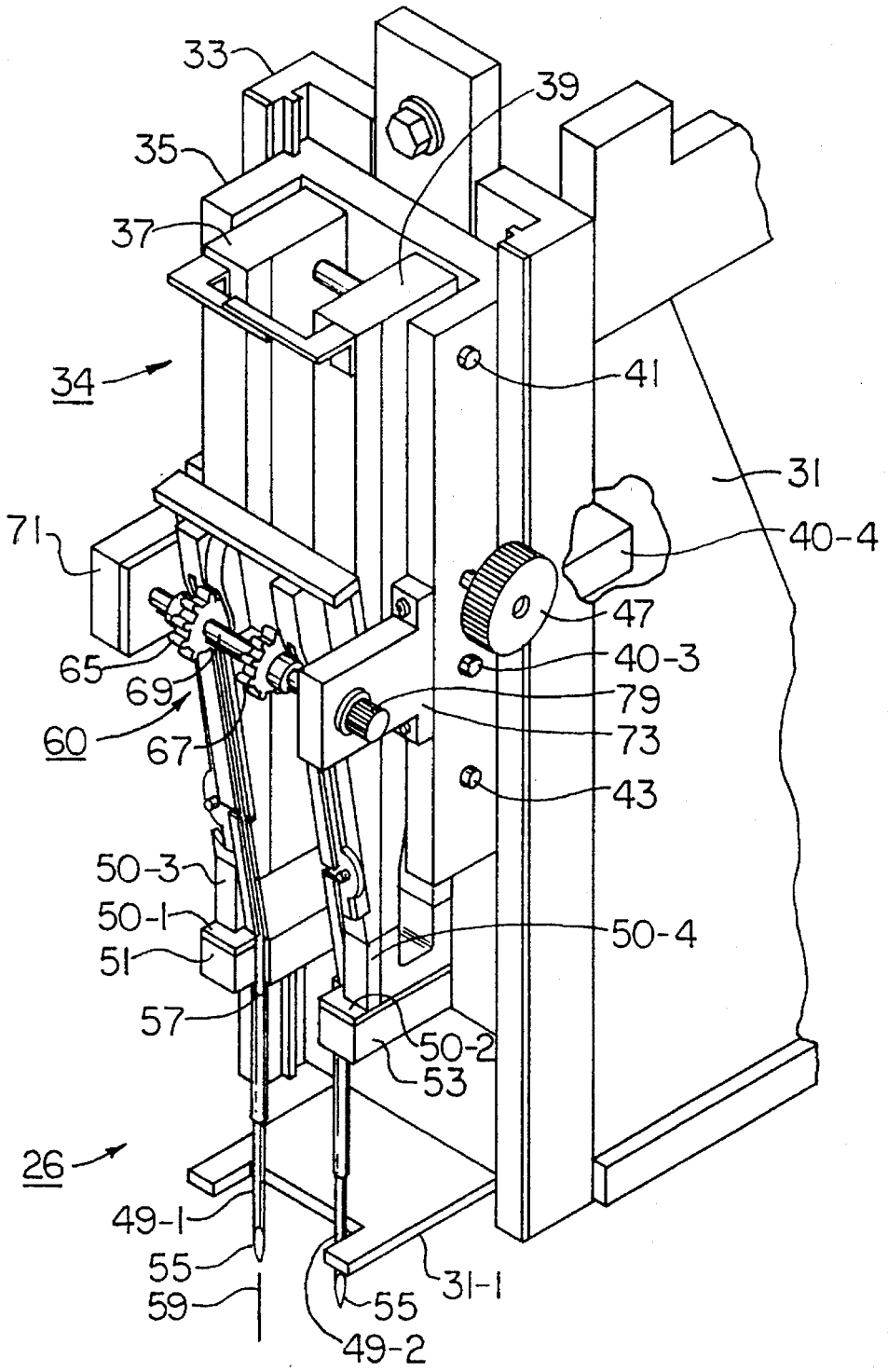
FIG. 4 is a fragmentary perspective view of an apparatus for dispensing attachments from continuous connected ladder stock constructed according to this invention, with parts not pertinent to this invention not being shown for simplicity and clarity.
Figure 6:
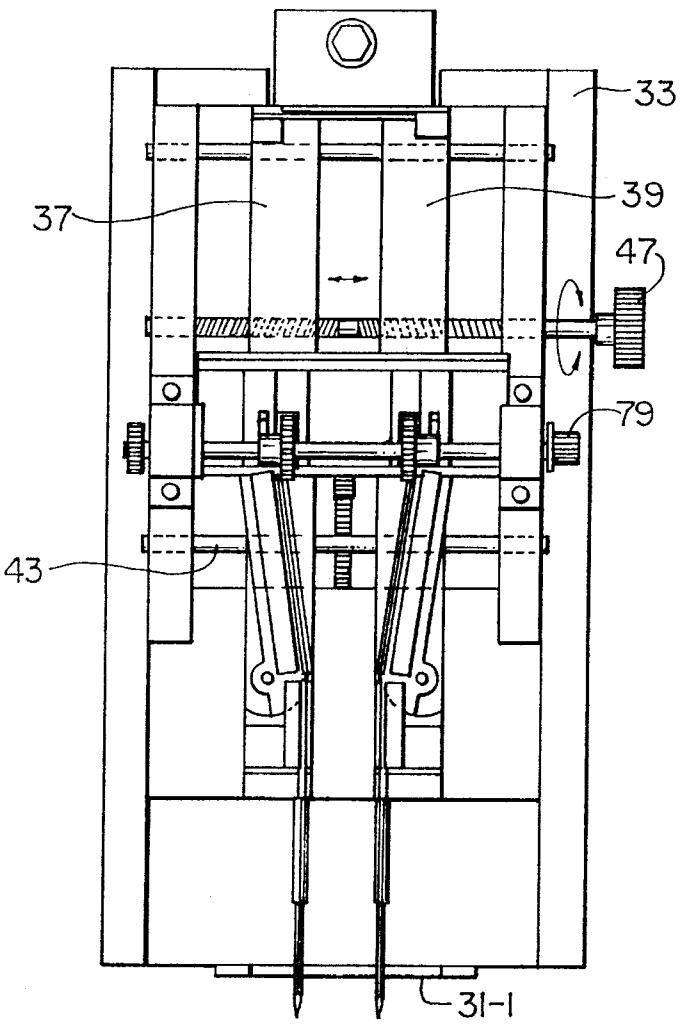
FIG. 6 is a front elevation view of the apparatus shown in FIG. 4, but with the carrier blocks moved closer to each other than in FIG. 4.
Figure 5:
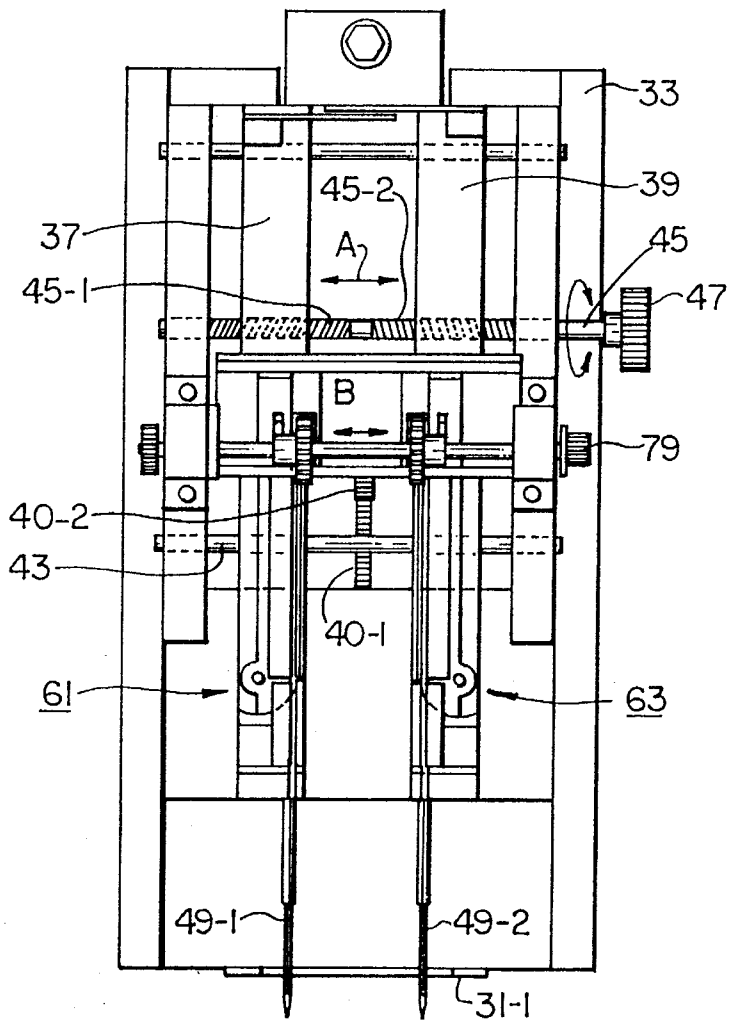
FIG. 5 is a front elevation view of the apparatus shown in FIG. 4.
Figure 7:
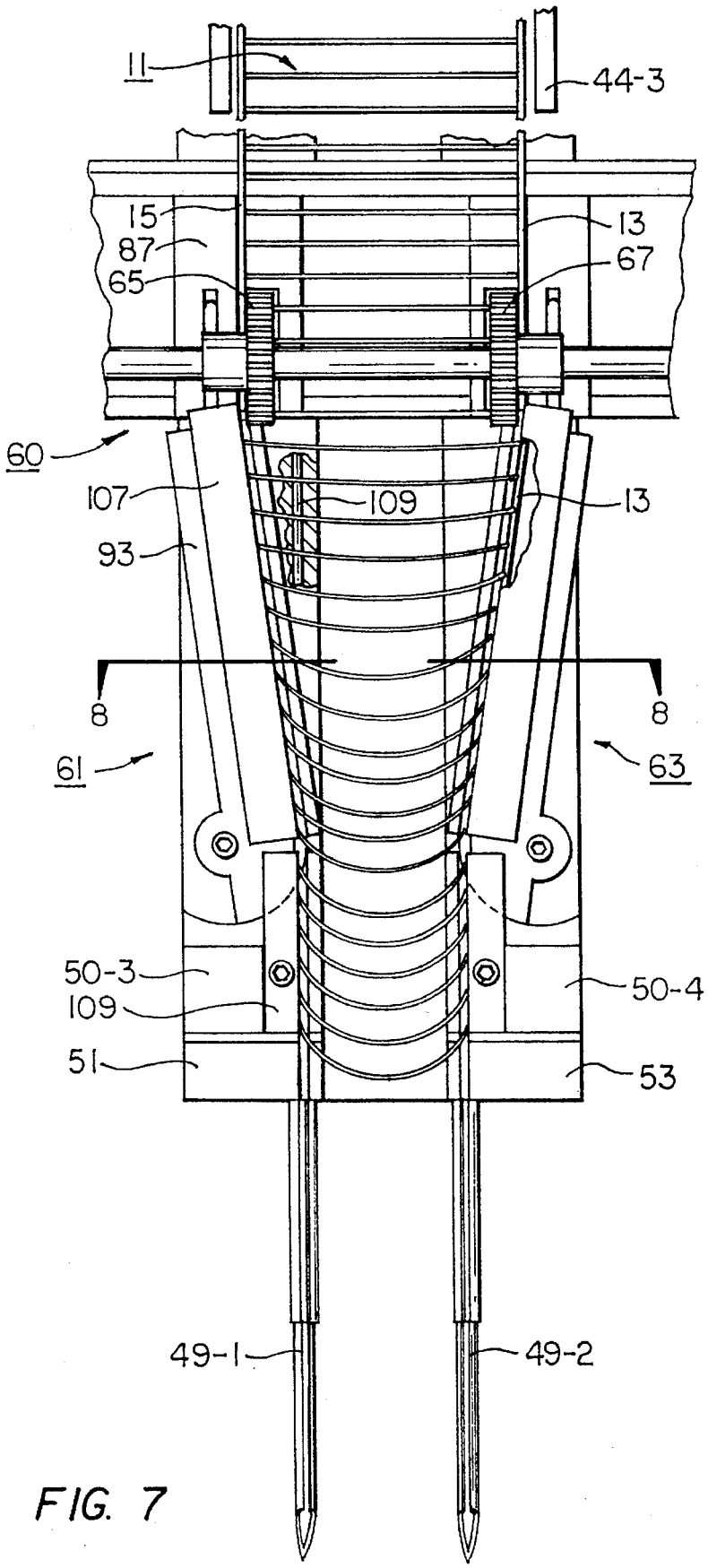
FIG. 7 is an enlarged fragmentary front elevation view broken away in parts of a portion of the apparatus shown in FIG. 4 along with a length of continuously connected ladder stock loaded in place for dispensing.

Referring now to FIGS. 4 through 11, there is shown in FIG. 4 a simplified fragmentary perspective view of an apparatus for dispensing attachments according to this invention, the apparatus being represented by reference numeral 26. A front elevation view of apparatus, 26 is shown in FIG. 5. A front elevation view of apparatus 26 but with the needles closer than in FIG. 5 is shown in FIG. 6. A fragmentary front elevation view of apparatus 25 partly broken away and with ladder stock loaded therein, is shown in FIG. 7. For illustrative purposes only, the ladder stock shown in FIG. 7 is ladder stock 11.

Portions of apparatus 26 not pertinent to this invention are not shown or described.

Apparatus 26 includes a frame 31, and a head assembly 32. Frame 31 includes a bottom plate 31-1. Head assembly 32 includes a mount 33 and a head 34. Head 34 includes a support 35 and a pair of carrier blocks 37 and 39. Mount 33 is fixedly attached to frame 31. Support 35 is slidably mounted for vertical movement on mount 33. The sliding vertical movement of support 35 relative to mount 33 is used to actuate the feeding, severing and ejecting mechanisms employed in the operation of apparatus 25. The vertical movement of support 35 on mount 33 is achieved by a rack 40-1 and pinion 40-2, rack 40-1 being fixed to mount 33 and pinion 40-2 being mounted on a shaft 40-3 driven by a motor 40-4. The rack and pinion arrangement and the motor arrangement are the same as the arrangement in PCT published application No. PCT/US94/01855.

Carrier blocks 37 and 39 are vertically disposed and mounted on a pair of horizontal support rods 41 and 43 for slidable movement sideways relative to each other in the direction as shown by arrow A in FIG. 5. Rods 41 and 43 are fixedly attached to support 35 by suitable means, not shown. A pair of brackets 44-1 and 44-2 are fixedly attached to carrier blocks 37 and 39 for guiding ladder stock 11 from a supply reel 44-3 into the feed portion of apparatus 11. Carrier blocks 37 and 39 are moved horizontally toward or away from each other along rods 41 and 43 by turning an adjusting rod 45 which is mounted on support 35 for rotation about its longitudinal axis. Rod 45 is provided with left and right threaded portions 45-1 and 45-2, respectively, which engage threaded holes in carrier blocks 37 and 39 respectively. Consequently, when rod 45 is rotated in one direction, carrier blocks 37 and 39 will be moved towards each other and when rod 45 is rotated in the opposite direction, the carrier blocks will be moved away from each other. Rod 45 includes a knob 47 to assist in turning it manually.

Apparatus 26 also includes a pair of parallel, disposed hollow slotted needles 49-1 and 49-2 and a pair of knifes 50-1 and 50-2. Needle 49-1 is mounted on a needle block 51 which is attached to the bottom of carrier block 37 and needle 49-2 is mounted on a needle block 53 which is attached to the bottom of carrier block 39. Each needle is shaped to include a tip 55, a rear end 57 and a longitudinal axis 59 and is oriented vertically so that its longitudinal axis is parallel to the direction in which support 35 moves. Since needle blocks 51 and 53 are mounted on carrier blocks 37 and 39, respectively, the spacing between needles 49-1 and 49-2 can be changed by moving carrier blocks 37 and 39 inward or outward relative to each other. Knifes 50-1 and 50-2 are mounted on knife blocks 50-3 and 50-4 which are fixedly secured to carrier blocks 37 and 39, respectively.

Figure 11:
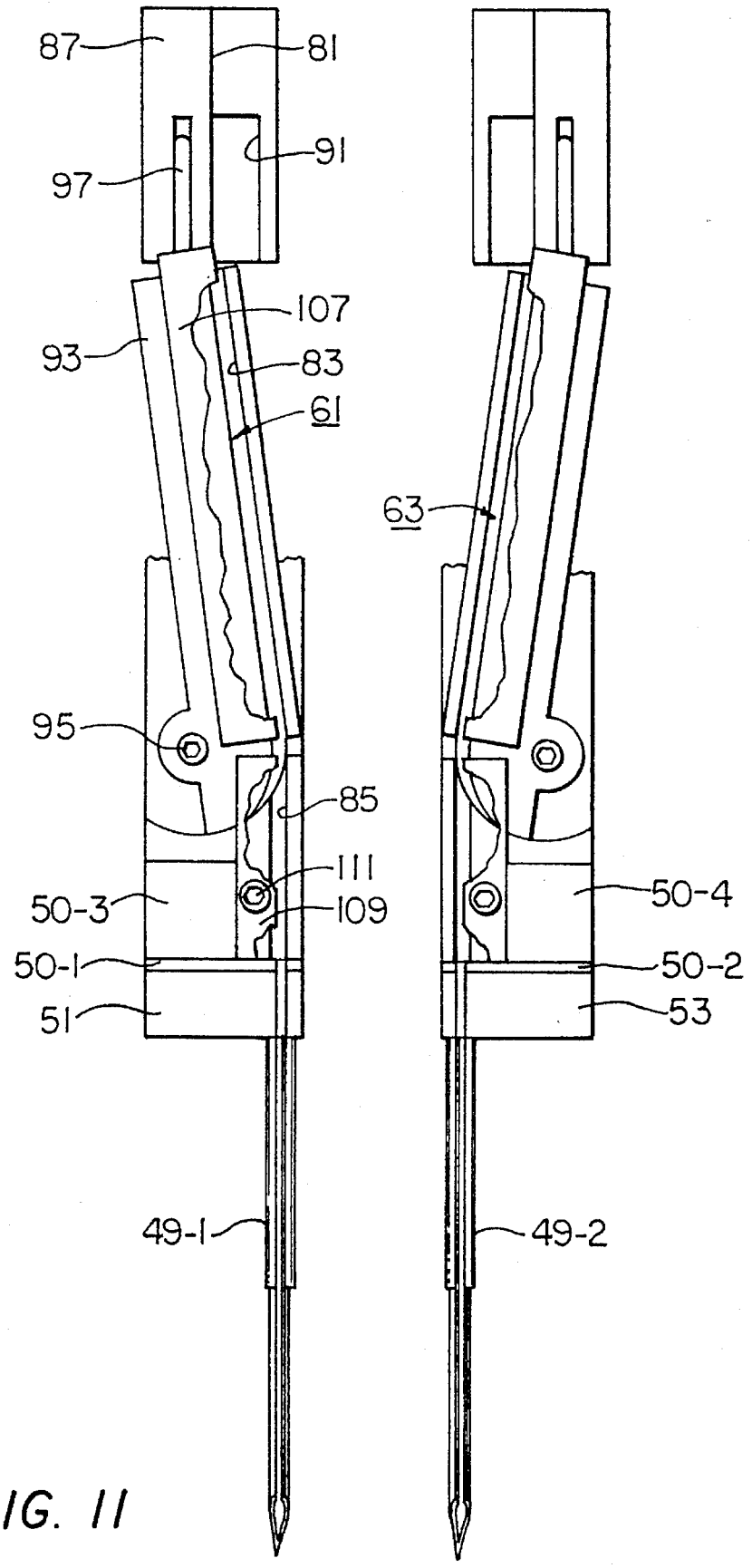
FIG. 11 is a front elevation view of the feed track and needle portions of the apparatus shown in FIG. 4.

Apparatus 26 also includes a feed mechanism 60 for feeding ladder stock 11 along a pair of feed tracks 61 and 63, see also FIG. 11, into needles 49-1 and 49-2 respectively.

Feed mechanism 60 comprises a pair of feed wheels 65 and 67 mounted on a shaft 69 for slidable movement toward and away from each other as shown by arrow B in FIG. 5. Shaft 69 is rotably mounted on a pair of brackets 71 and 73 fixedly attached by screws 75 to support 35. Feed wheels 65 and 67 are keyed to shaft 69 for rotation therewith, the key arrangement not being shown but being identical to that shown in U.S. Pat. No. 3,875,648. Shaft 69 is driven by a ratchet and pawl arrangement 76 at one end of shaft 69 and identical to that shown in pending U.S. patent application Ser. No. 08/025,044. A knob 79 is coupled to the other end of shaft 69 so that shaft 69 can be turned manually, if desired, to advance the ladder stock.

As can be readily seen, the spacing between feed wheels 65 and 67 can be changed without changing the spacing between needles 49-1 and 49-2 in order, for example, to accommodate changes in the width of the ladder stock being used. Also, the spacing between needles 49-1 and 49-2 can be changed without changing the spacing between feed wheels 65 and 67 in order, for example, to accommodate changes in the size of the item with which the dispensed attachments are being used.

Figure 10:
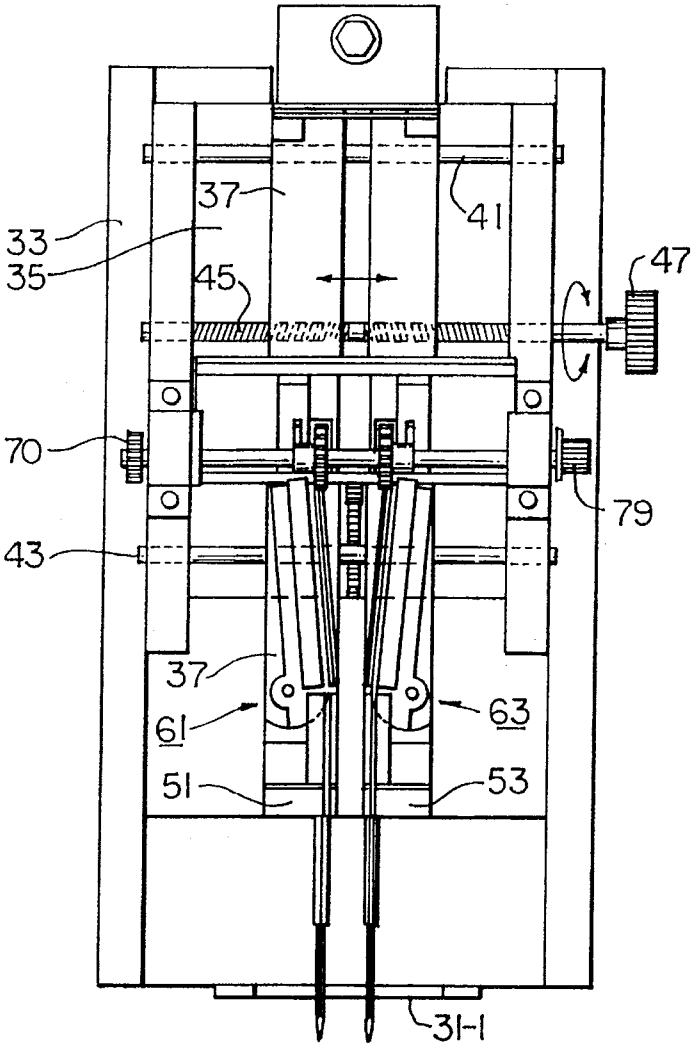
FIG. 10 is a front elevation view of the apparatus shown in FIG. 4, but with the carrier blocks closer to each other than in FIG. 8 and the feed wheels at the same spacing as in FIG. 8.
Figure 9:
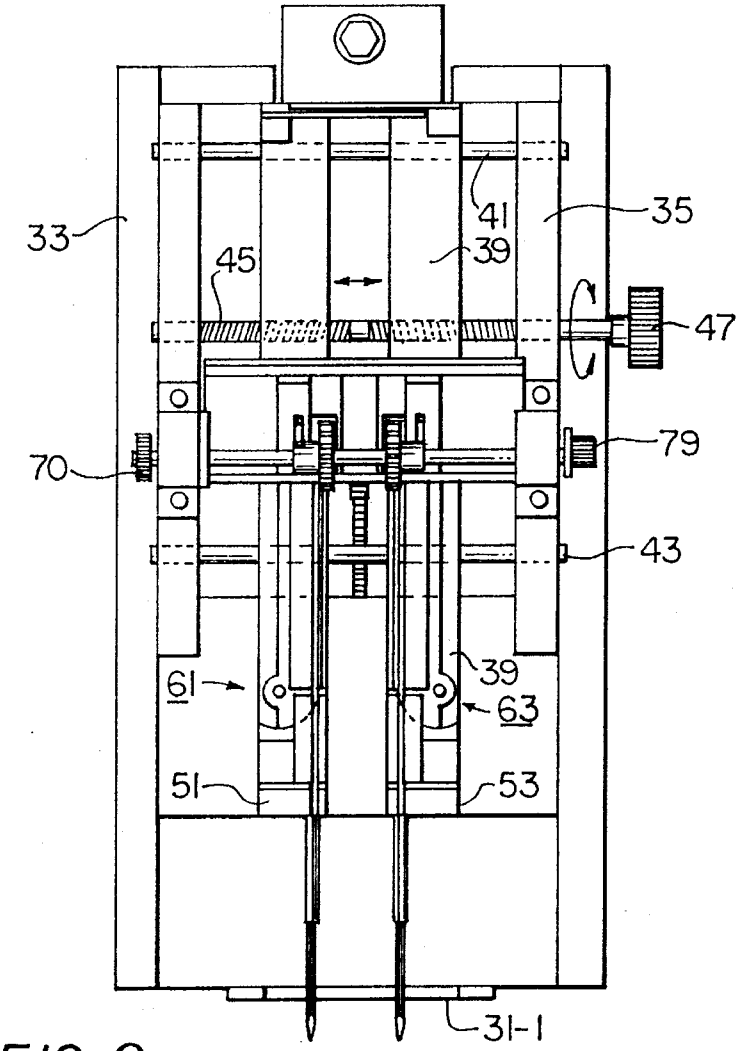
FIG. 9 is a front elevation view of the apparatus shown in FIG. 4, but with the carrier blocks and feed wheels moved closer to each other than in FIG. 4.

FIG. 5 shows the feed wheels and needles at one setting and FIG. 6 shows the feed wheels at the same setting as in FIG. 5 but the needles moved in closer to each other than in FIG. 5. FIG. 9 shows the feed wheels and needle each at a different setting other than in FIG. 5 and FIG. 10 shows the feed wheels at the same setting as FIG. 9 but the needles moved in closer to each other than in FIG. 9.

Feed tracks 61 and 63 guide side members 13 and 15 of ladder stock 11 from feed wheels 65 and 67, respectively, into rear ends 57 of needles 49-1 and 49-2.

Feed track 61 includes an upper section 81, an intermediate section 83 and a lower section 85.

Upper section 81 is an outwardly extending vertical wall formed in a block of rigid material 87 which is mounted on a shelf 89 fixedly attached to brackets 71 and 73. Block 87 is mounted on shelf 89 for slidable movement in the direction of arrow B in FIG. 5. Block 87 is shaped to also include a recess 91 into which extends the toothed portion of feed wheel 65. Thus, if block 87 is slidably moved along shelf 89 it will carry feed wheel 65 along with it.

Figure 8:
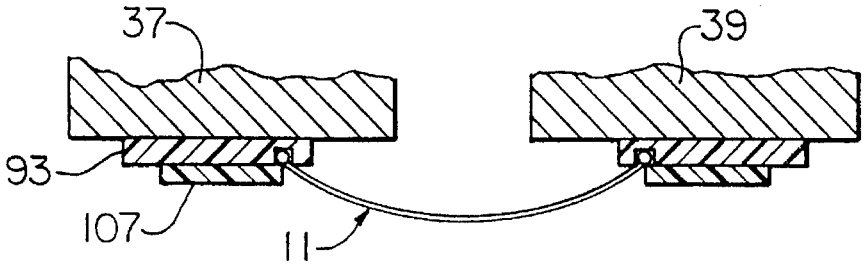
FIG. 8 is a simplified section view taken along lines 8—8 in FIG. 7.
Figure 12:
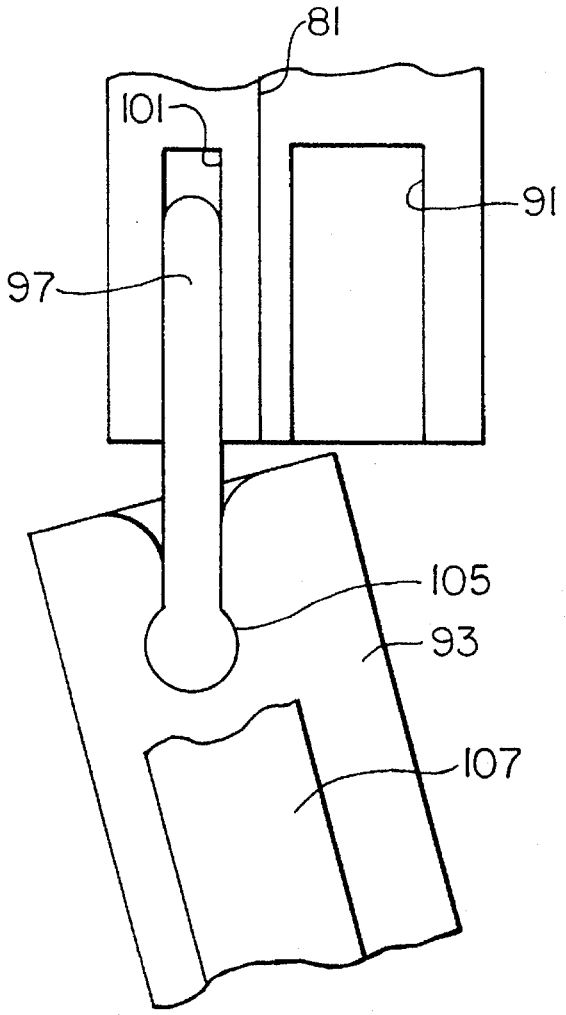
FIG. 12 is an enlarged fragmentary plan view of the pivot joint shown in FIG. 4 along with the two parts which are interconnected by the pivot joint.

Intermediate section 83 of feed track 61 is a channel formed in an elongated strip of rigid material 93. Strip 93 is pivotally attached near its bottom end 94 to carrier block 37 by a pivot pin 95 and is pivotally coupled near its other end to upper section 81 by a pivot joint 97. Pivot joint 97 includes a main body portion 99 which rides in a slot 101 formed in upper section 81 and rounded bottom end portion 103 which rides in a socket 105 formed in strip 93 near the top. A cover plate 107 is fixedly attached to strip 93 and extends partially over channel 83, as shown in FIG. 8.

Lower section 85 of feed track 61 is a channel formed in carrier block 37 and needle block 51. Lower section 85 is covered by an elongated plate 109 which is attached to carrier block 37 by a screw 111.

Feed track 63 is a mirror image of feed track 61.

Because feed tracks 61 and 63 each include a pivotally mounted section, i.e. the intermediate section, the feed tracks will provide a path leading from the feed wheels to the needle, even if the needle spacing (or feed wheel spacing) is changed.

Apparatus 26 also includes a pair of ejector rods, one of which is shown in FIG. 7 and numbered 109, for pushing the attachments, through needles 49-1 and 49-2 after they have been severed from the ladder stock.

Attachments are dispensed from apparatus 26 in the same sequence of steps as in PCT International Application No. PCT/US94/01855.

The embodiments of the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. Apparatus for dispensing attachments from continuously connected ladder stock, the continuously connected ladder stock comprising a pair of plastic side members coupled together by a plurality of plastic cross links, said apparatus comprising:

a mount, a support mounted on said mount, a pair of carrier blocks mounted on said support, a pair of needle blocks, one mounted on each carrier block, a pair of hollow, slotted needles, one mounted on each needle block, a feed mechanism mounted on said support for advancing the continuously connected ladder stock into said hollow slotted needles, said feed mechanism including a pair of feed wheels, a pair of feed tracks, one for each hollow slotted needle, through which the continuously connected ladder stock passes from said feed wheels into said pair of hollow slotted needles, severing means for severing an attachment to be dispensed through said hollow slotted needles from said continuously connected ladder stock, and ejector means for ejecting a severed attachment through said hollow slotted needles, said carrier blocks being disposed parallel to each other and being movable sideways relative to each other so that the spacing between the hollow slotted needles can be changed, said feed wheels being disposed parallel to each other and being movable sideways relative to each other so that their spacing can be changed to accommodate different widths of continuously connected ladder stock, said carrier blocks being movable sideways relative to each other independent of said feed wheels and said feed wheels being movable sideways relative to each other independent of said carrier blocks.

2. The apparatus of claim 1, wherein each one of said pair of feed tracks includes a pivotally mounted section to enable said apparatus to accommodate changes in at least one of feed wheel spacing and needle spacing.

3. The apparatus of claim 2 wherein said feed mechanism further includes a shaft rotably mounted on said support and wherein said feed wheels are slidably mounted on said shaft.

4. The apparatus of claim 3 wherein said feed wheels are keyed to said shaft for rotation therewith.

5. The apparatus of claim 4 wherein each feed track includes an upper section, an intermediate section and a lower section and wherein said pivotally mounted section is said intermediate section.

6. The apparatus of claim 5 wherein said upper section is slidably mounted on said support.

7. The apparatus of claim 6 wherein said pivotally mounted section is pivotally mounted at one location to a carrier block and at another location to said upper section.

8. Apparatus for dispensing attachments from continuously connected ladder stock, the continuously connected ladder stock comprising a pair of plastic side members coupled together by a plurality of plastic cross links, said apparatus comprising:

a pair of parallel disposed hollow, slotted needles, a pair of parallel disposed feed wheels for advancing the continuously connected ladder stock into said hollow slotted needles, and a pair of feed tracks through which said continuously connected ladder stock passes from said feed wheels into said pair of hollow slotted needles, and said feed wheels being movable sideways relative to each other so as to accommodate different sized continuously connected ladder stock, said needles being movable sideways relative to each other to accommodate different needle spacings, and each one of said pair of feed tracks including a pivotally mounted section to enable said apparatus to accommodate changes in at least one of feed wheel spacing and needle spacing.

* * * * *